US005542460A

United States Patent [19]

McKeon

[11] Patent Number: 5,542,460

[45] Date of Patent: Aug. 6, 1996

[54] SELF-CLOSING FIRE DOOR

[75] Inventor: James McKeon, Brooklyn, N.Y.

[73] Assignee: McKeon Rolling Steel Door Company, Inc., Brooklyn, N.Y.

[21] Appl. No.: 298,430

[22] Filed: Aug. 30, 1994

Related U.S. Application Data

[62] Division of Ser. No. 992,441, Dec. 17, 1992, Pat. No. 5,355,927.

[51] Int. Cl.[6] ..... E05F 15/20

[52] U.S. Cl. ..... 160/7; 160/1; 160/84.01; 160/188

[58] Field of Search ..... 160/1, 7, 8, 9, 160/133, 189, 188, 310, 84.1 R, 84.1 A, 40

[56] References Cited

U.S. PATENT DOCUMENTS 4,738,296 4/1988 Hatch .
5,203,392 4/1993 Shea .
5,355,927 10/1994 McKeon .

*Primary Examiner*—Blair Johnson
*Attorney, Agent, or Firm*—Cohen, Pontani, Lieberman, Pavane

[57] ABSTRACT

The present invention is provided with a mechanism for controlling the opening and closing of a door comprising a speed reduction means for reducing a rotational speed. A high speed shaft is connected to the speed reduction means and is connectable to a means for rotating the input shaft, and a low speed output shaft is connected to the speed reduction means. A governor is mounted on the input shaft for limiting the rotational speed thereof, to also regulate the rotational speed of the output shaft. A brake is provided for preventing rotation of the output shaft, and a self-closing mechanism is operatively connected to the door. The self-closing mechanism is adapted for storing energy when the door is opened to an open position, and a connecting means operatively connects the output shaft to the self-closing mechanism. A releasing means is provided for releasing the brake to permit rotation of the output shaft under the urging of the self-closing mechanism whereby the self-closing mechanism releases the energy stored therein so as to close the door to a closed position when the brake is released by the releasing means.

15 Claims, 12 Drawing Sheets

10
12
13
14
16
18
20
22
24
26
34
3
4
6
8
11

206
64
208
210
212
84
209
204
70
200
180
178
176
202
53
50
13
52
54

70
216
206
214
212
209
64
208
84
9
210
204
202
9

122
120
127
125
112
114
140
123
110
138
118
136
128
124
126
134

SELF-CLOSING FIRE DOOR

This is a division of application Ser. No. 07,992,441, filed Dec. 17, 1992 now U.S. Pat. No. 5,355,927.

FIELD OF THE INVENTION

The present invention is directed to a self-closing fire door, in particular a self-closing fire door comprising an operator for controlling the opening and closing of the door. The fire door comprises a curtain including a plurality of interconnected relatively pivotal slats aligned in a first direction and a pair of perpendicular guides positioned at either side of the curtain for guiding the curtain for movement between a first, open position and a second, closed position. The operator is used for regulating the opening and closing of the fire door. During normal ambient conditions, the operator holds the door open; however, if a fire occurs the operator releases the fire door permitting energy which has been stored in a self-closing mechanism to be transferred through the operator and to act on the fire door. The operator regulates the closing of the door for blocking the opening and to prevent the fire from spreading from one location to another.

BACKGROUND OF THE INVENTION

Fire doors are provided in buildings to prevent the spread of fires from one portion of the building to other portions. Various types of fire doors are provided to close different kinds of openings generally found in buildings. For example, for a vertical opening having a relatively short width in relation to its height, a vertical fire door is provided which can close in the direction from top to bottom, as shown in FIG. 14, referred hereinafter as a vertically closing fire door. Alternatively, as shown in FIG. 15, a fire door can be arranged to close in the direction from the bottom of the opening to the top, referred to hereinafter as an inverted vertical closing fire door. For a vertical opening that has a relatively large width or that is irregularly shaped, a fire door is provided which closes from side to side, as shown in FIG. 13, referred hereinafter as a side closing fire door. To enclose an area where there is an opening in the floor, such as a stairway or escalator, a horizontal fire door is provided, as shown in FIGS. 1 and 2.

Heretofore the inverted vertical fire door, the side closing fire door and the horizontal fire door each required an auxiliary power source, such as a battery backup system, auxiliary generator or the like, to supply energy to a motor to close such doors. However, in the event of a fire, such auxiliary power sources are apt to be damaged due to extreme heat, rendering such inverted vertical, side closing and horizontal fire doors inoperative. Accordingly, fire codes have been promulgated in the United States that require fire doors to close in response to a fire without the use of an auxiliary power source. In view of the above discussed problems, the inverted vertical, side closing and horizontal fire doors have not been generally used in the United States. On the other hand, the vertical fire door generally relies on gravity acting on the weight of the door to assist in closing and therefore it does not require an auxiliary power source.

U.S. Patent application No. 07/859,833, U.S. Pat. No. 5,203,392 is an example of a vertical fire door, the disclosure of which is incorporated herein by reference. Such a fire door comprises a plurality of interconnected relatively pivotal horizontal slats and a pair of vertical guides positioned on either side of the curtain for guiding the curtain for vertical movement between a first or raised position and a second or lowered position. A mechanism is further provided for regulating the speed of the raising and lowering of the fire door. Under normal ambient conditions, the mechanism holds the door open; however, if a fire occurs the mechanism releases the fire door permitting the regulated closing of the door to secure a doorway and to prevent the fire from spreading from one location to another. This application, however, does not attempt to solve the problem of other types of fire doors previously discussed.

U.S. Pat. No. 4,754,795 to Garrod is directed to a rolling shutter for closing a doorway from a side-to-side direction, the disclosure of which is incorporated herein by reference. The Garrod device comprises a roller mounted vertically and comprises an inner shaft and an outer tube. A shutter curtain is adapted to be wound on the outer tube in a withdrawn condition, and a guide means is arranged to support the weight of the curtain in the extended condition and comprises a top track. The roller includes a resilient tensioning means for tensioning the curtain and provides a substantially constant tensioning force on the curtain throughout its travel between the withdrawn and extended conditions. The curtain is opened and closed by an electrical motor.

British Patent Application 2,172,327 also to Garrod is directed to a similar roller shutter as descried in U.S. Pat. No. 4,754,795, but is arranged for closing and opening in a substantially horizontal direction. This apparatus also requires an electric motor for opening and closing the curtain.

Since both devices to Garrod require an electric motor to open and close the door, neither one solves the above described problem.

OBJECT OF THE INVENTION

Accordingly, it is the object of the present invention to provide a self-closing fire door which overcomes the aforementioned problems.

It is a further object of the invention to provide a horizontally closing fire door comprising a self-closing mechanism without utilizing an auxiliary electric power source.

It is another object of the present invention to provide a vertical fire door for closing in a side-to-side direction comprising a self-closing mechanism which does not require an auxiliary electrical power source.

It is a still further object of the invention to provide an inverted closing vertical fire door, i.e. closing an opening from the bottom to the top, comprising a self-closing mechanism which does not require the use of an auxiliary electrical power supply.

Other objects and features of the present invention will become apparent from the following detailed description considered in conjunction with the accompanying drawings. It is to be understood, however, that the specification and drawings are intended for the purposes of illustrating the preferred embodiments and not as a definition of the limits of the invention, for which references should be made to the appended claims.

SUMMARY OF THE INVENTION

In a current embodiment of the present invention, a mechanism for controlling opening and closing of a door comprises a speed reduction means for reducing a rotational speed. A high speed shaft is connected to the speed reduction means and is connectable to a means for rotating the input shaft, and a low speed output shaft is connected to the speed reduction means. A governor is mounted on the input shaft for limiting the rotational speed thereof and to also regulate the rotational speed of the output shaft. A brake is provided for preventing rotation of the output shaft, and a self-closing mechanism is operatively connected to the door. The self-closing mechanism is adapted for storing energy when the door is opened to an opened position, and a connecting means operatively connects the output shaft to the self-closing mechanism. A releasing means is provided for releasing the brake to permit rotation of the output shaft under the urging of the self-closing mechanism, whereby the self-closing mechanism releases the stored energy therein so as to close the door when the brake is released by the releasing means.

According to another aspect of the present invention, a door is provided comprising a curtain including a plurality of interconnected relatively pivotal slats aligned in a single direction. A guide is positioned on one side of the curtain for guiding the curtain for movement between a first or opened position and a second or closed position. An outer tube is operatively connected to the first end of the curtain for winding the curtain thereabout for opening the curtain to the opened position and for unwinding the curtain for closing the curtain to the closed position. A resilient tension means is disposed between the outer tube and an inner shaft, a first portion of the resilient tensioning means being operatively connected to the outer shaft and a second portion of the resilient tensioning means being operatively connected to the inner shaft. A regulating means is provided for regulating the speed of the curtain comprising a speed reduction means for reducing the rotational speed, high speed input shaft connected to the speed reduction means, a low speed output shaft connected to the speed reduction means, and a governor mounted on the input shaft for limiting the rotational speed thereof so as to also regulate the rotational speed of the output shaft. A self-closing mechanism is operatively connected to the curtain and is adapted for storing energy when the curtain is moved to the opened position. A connecting means operatively connects the output shaft to the self-closing mechanism and the inner shaft, such that the tension of the resilient tensioning means is maintained substantially constant irrespective of the degree or opening or closing of the curtain. A brake is provided for preventing the rotation of the output shaft. A releasing means releases the brake to permit rotation of the output shaft under the urging of the self-closing mechanism, whereby the self-closing mechanism releases the energy stored therein so as to close the curtain to the closed position when the brake is released by the releasing means.

According to a further aspect of the present invention, a mechanism is provided for controlling the opening and closing of a door comprising a reversible speed reduction mechanism having a high speed and a low speed end, the mechanism operable in a first and a reverse direction. A high speed input shaft is connected to the high speed end of the speed reduction means and is connectable to a means for rotating the high speed shaft. A low speed shaft is connected to the low speed end of the speed reduction means, and a brake is provided for preventing rotation of the output shaft. A self-closing mechanism is operatively connected to the door and is adapted for storing energy when the door is opened. The connecting means is operatively connected between the output shaft and the self-closing mechanism. A releasing means is provided for releasing the brake to permit rotation of the output shaft under the urging of the self-closing mechanism, such that the self-closing mechanism releases the stored energy therein so as to close the door when the brake is released by the releasing means.

According to an additional aspect of the present invention, a door comprises a curtain including a plurality of interconnected relatively pivotal slats aligned in a single direction. A guide is positioned on one side of the curtain for guiding the curtain for movement between a first or opened position and a second or closed position. An outer tube is operatively connected to the first end of the curtain for winding the curtain thereabout for opening the curtain to the opened position and for unwinding the curtain for closing the curtain to the closed position.

A resilient tensioning means is provided between the outer tube and an inner shaft, the first portion of the resilient tensioning means being operatively connected to the outer tube and a second portion of the resilient tensioning means being operatively connected to the inner shaft. A regulating means is provided for regulating the speed of the curtain comprising a speed reduction mechanism having a high speed end and a low speed end, a high speed input shaft connected to the high speed end of the speed reduction mechanism and a low speed shaft connected to the low speed end of the speed reduction mechanism. The speed reduction mechanism is operative in a first direction and a reverse direction. A self-closing mechanism is operatively connected to the curtain and is adopted for storing energy when the curtain is moved to the opened position. A connecting means operatively connects the output shaft to the self-closing mechanism and the inner shaft, such that the tension of the resilient tensioning means is maintained substantially constant irrespective of the degree of opening or closing of the curtain. A brake is provided for preventing rotation of the output shaft. A releasing means releases the brake to permit rotation of the output shaft under the urging of the self-closing mechanism, whereby the self-closing mechanism releases the stored energy therein so as to close the curtain to the closed position when the brake is released by the releasing means.

According to still yet another aspect of the present invention, a door comprises a curtain including a plurality of interconnected relatively pivotal slats aligned in a single direction. A guide is positioned on one side of the curtain for guiding the curtain for movement between a first or opened position and a second or closed position. An outer tube is operatively connected to a first end of the curtain for winding the curtain thereabout for opening the curtain to the opened position and for unwinding the curtain for closing the curtain to the closed position. A resilient tensioning means is disclosed between the outer tube and an inner shaft, a first portion of the resilient tensioning means being operatively connected to the outer tube and a second portion of the resilient tensioning means being operatively connected to the inner shaft. A regulating means is provided for regulating the speed of the curtain comprising a speed reduction means for reducing rotational speed, a high speed input shaft connected to the speed reduction means, a low speed output shaft connected to the speed reduction means, and a governor mounted on the input shaft for limiting the rotational speed thereof, so as to regulate the rotational speed of the output shaft. A connecting means is provided for operatively connecting the output shaft to the inner tube such that the tension of the resilient tensioning means is maintained substantially constant irrespective of the degree of opening or closing of the curtain. A brake is provided for preventing rotation of the output shaft and the releasing means releases the brake to permit rotation of the output shaft.

According to still yet a further aspect of the present invention, a door comprises a curtain including a plurality of interconnected relatively pivotal slats aligned in a single direction. A pair of guides is positioned on either side of the curtain for guiding the curtain for movement between a first or opened position and a second or closed position. An elongated rotatable member is operatively connected to a first end of the curtain for winding the curtain thereabout for opening the curtain to the opened position and for unwinding the curtain for closing the curtain to the closed position. A regulating means regulates the speed of the curtain comprising a speed reduction means for reducing a rotational speed, a high speed input shaft connected to the speed reduction means, a low speed output shaft connected to the speed reduction means and a governor mounted on the input shaft for limiting the rotational speed thereof so as to regulate the rotational speed of the output shaft. A self-closing mechanism is operatively connected to the curtain and is adapted for storing energy when the curtain is moved to the opened position. A connecting means operatively connects the output shaft to the self-closing mechanism, and a brake is provided for preventing rotation of the output shaft. A releasing means releases the brake to permit rotation of the output shaft under the urging of the self-closing mechanism. The self-closing mechanism releases the stored energy therein so as to close the curtain-to the closed position when the brake is released by the releasing means.

According to still yet a further aspect of the present invention, a door comprises a door panel having a substantially planar member, and a guide is positioned on one side of the door panel for guiding the door panel for movement between a first or opened position and a second or closed position. A regulating means regulates the speed of movement of the door panel comprising a speed reduction means for reducing a rotational speed, a high speed input shaft connected to the speed reduction means, a low speed output shaft connected to the speed reduction means, and a governor mounted on the input shaft for limiting the rotational speed thereof so as to regulate the rotational speed of the output shaft. A self-closing mechanism is operatively connected to the door panel and is adapted for storing energy when the door panel is moved to the opened position. A connecting means operatively connects the output shaft to the self-closing mechanism, and a brake is provided for preventing the rotation of the output shaft. A releasing means releases the brake to permit rotation of the output shaft under the urging of the self-closing mechanism, such that the self-closing mechanism releases the stored energy therein so as to close the door panel to the closed position when the brake is released by the releasing means.

According to still yet an additional aspect of the present invention, a door comprises an accordion-like member comprising two confronting articulated walls formed of a flexible reticulated material. A guide is positioned on one side of the accordion-like member for guiding the accordion-like member for movement between a first or opened position and a second or closed position. A regulating means regulates the speed of movement of the accordion-like member and comprises a speed reduction means for reducing a rotational speed, a high speed input shaft connected to the speed reduction means, and a low speed output shaft connected to the speed reduction means. The regulating means is operable in a first direction toward the closed position and a second direction toward the opened position. A self-closing mechanism is operatively connected to the accordion-like member and is adapted for storing energy when the accordion-like member is moved to the opened position. A connecting means operatively connects the output shaft to the self-closing mechanism, and a brake is provided for preventing rotation of the output shaft. A releasing means releases the brake to permit rotation of the output shaft under the urging of the self-closing mechanism, such that the self-closing mechanism releases the stored energy so as to close the accordion-like member to the closed position when the brake is released by the releasing means.

According to still yet an additional aspect of the present invention, a mechanism is provided for controlling the opening and closing of the door comprising a speed reduction means for reducing rotational speed. A high speed input shaft is connected to the speed reduction means and is connectable to a means for rotating the input shaft, and a low speed output shaft is also connected to the speed reduction means. A governor is mounted on the input shaft limiting the rotational speed thereof, and a brake is provided for preventing the rotation of the output shaft. The self-closing means is operatively connected to the door and is adapted for storing energy when the door is opened to the opened position. A connecting means operatively connects the output shaft to the door. A releasing means is provided for releasing the brake to permit rotation of the output shaft on the urging of the self-closing mechanism, such that the self-closing mechanism releases the stored energy so as to close the door to a closed position when the brake is released by the releasing means.

According to yet another aspect of the present invention, a mechanism is provided for controlling the opening and closing of the door comprising a speed reduction means for reducing a rotational speed. A high speed input shaft is connected to the speed reduction means and is connectable to a means for rotating the input shaft. A low speed output shaft is connected to the speed reduction means, and a governor is mounted on the input shaft for limiting the rotational speed thereof and to also regulate the rotational speed of the output shaft. A brake is provided for preventing the rotation of the output shaft, and a self-opening mechanism is operatively connected to the door, the self-opening mechanism being adapted for storing energy when the door is closed to a closed position. A connecting means is provided for operatively connecting the output shaft to the self-opening mechanism. A releasing means releases the brake to permit rotation of the output shaft under the urging of the self-opening mechanism, such that the self-opening mechanism releases the energy stored therein so as to open the door to an opened position when the brake is released by the releasing means.

DETAILED DESCRIPTION OF THE DRAWINGS

In the drawings, wherein like reference characters denote similar elements throughout the several views.

Figure 10:
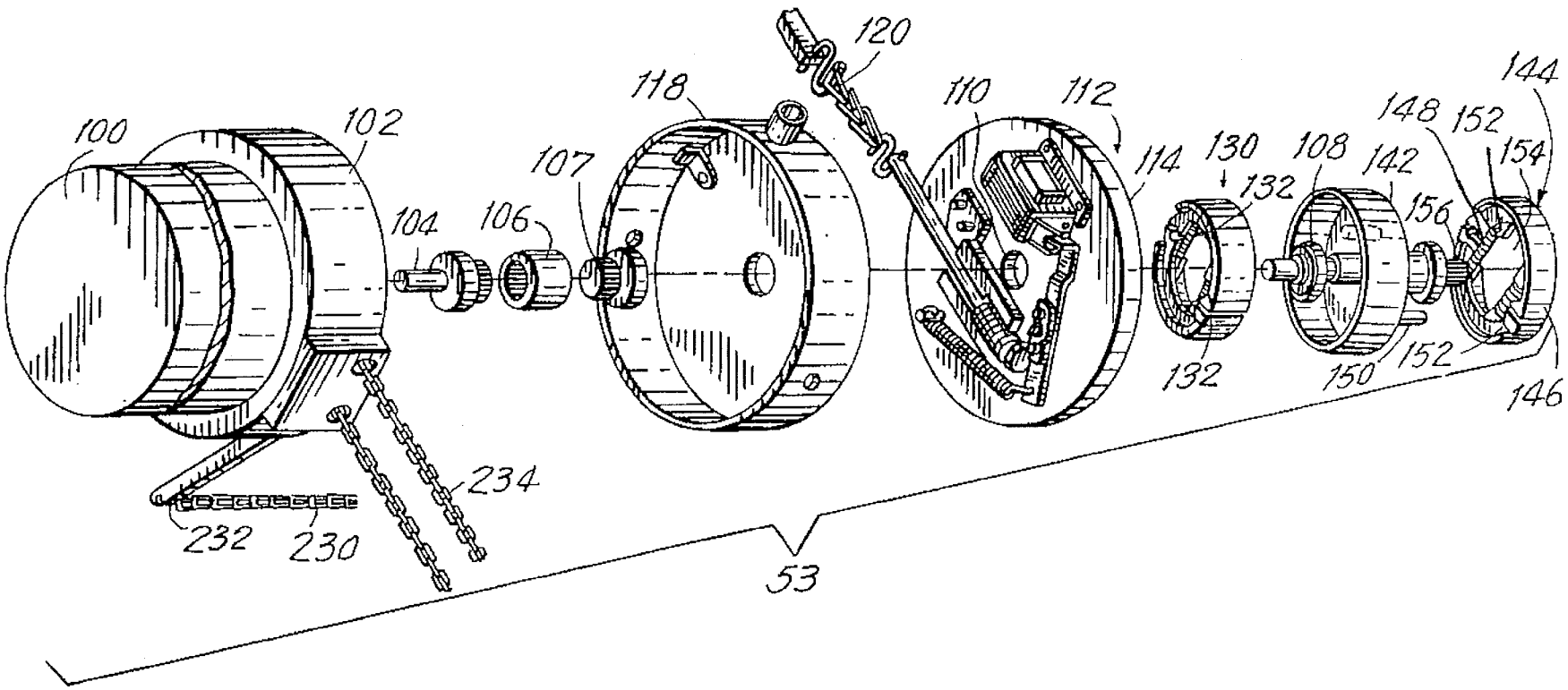
Figure 11:
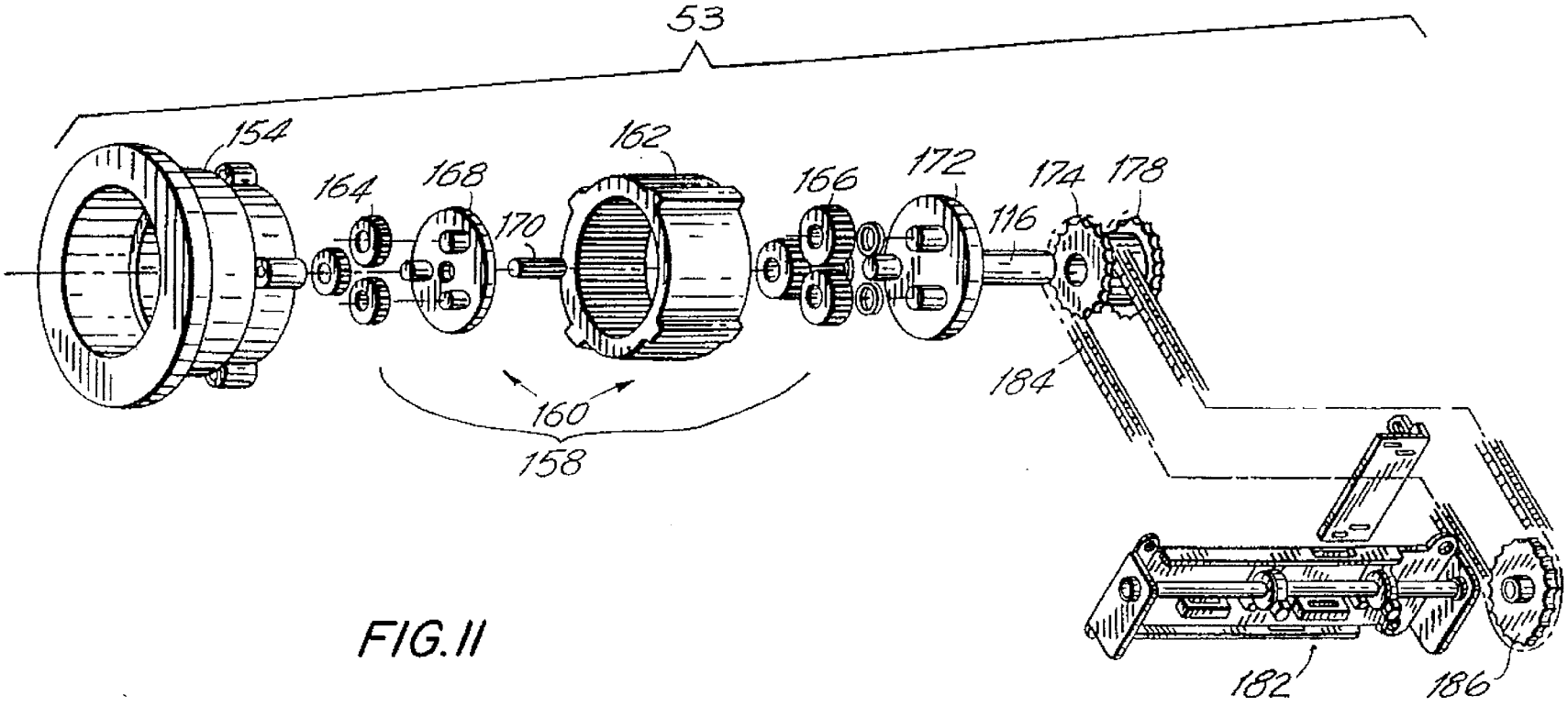
Figure 12:
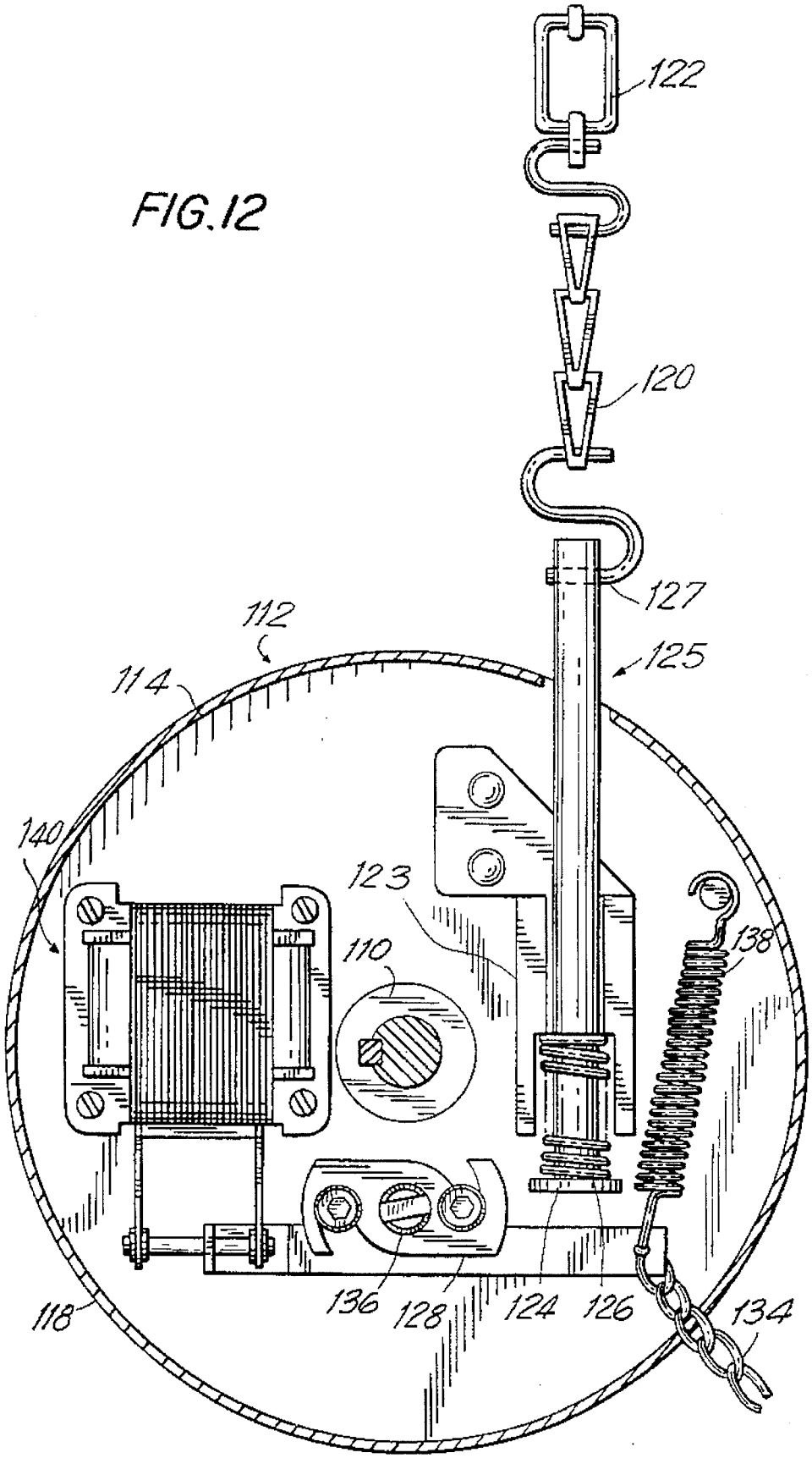
Figure 13:
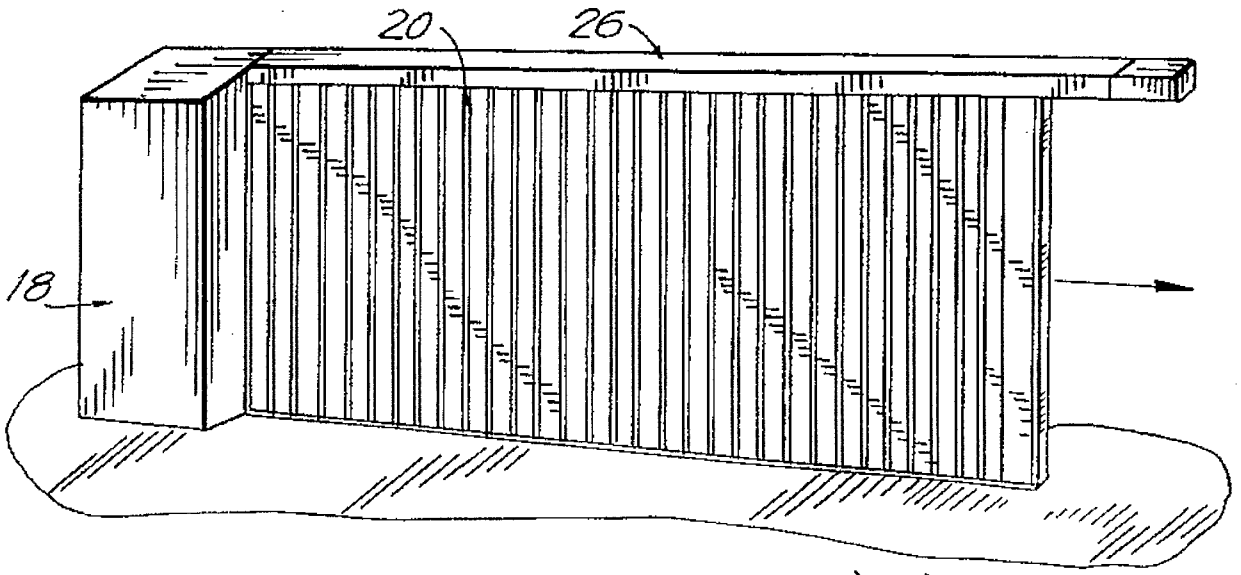
Figure 14:
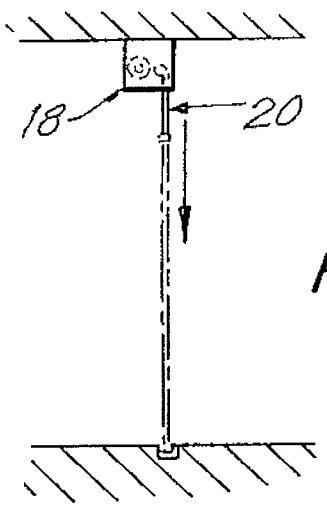
Figure 15:
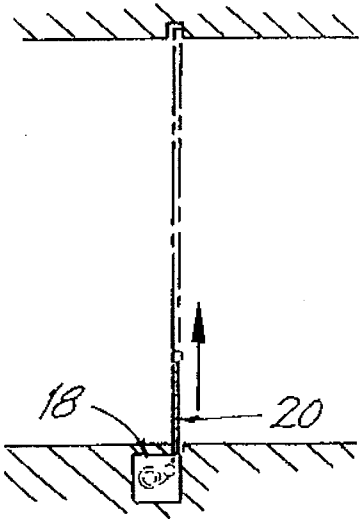
Figure 16:
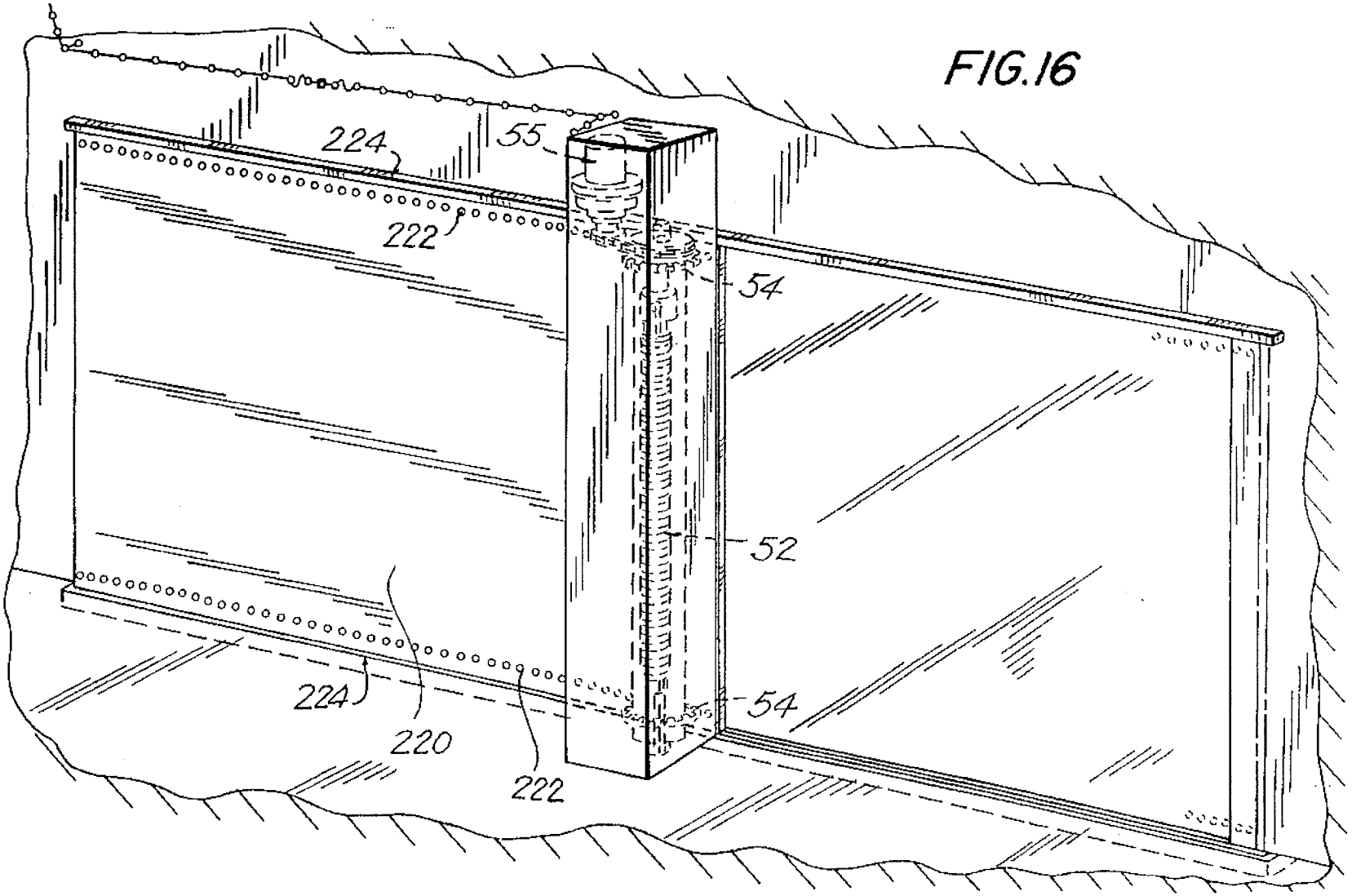
Figure 17A:
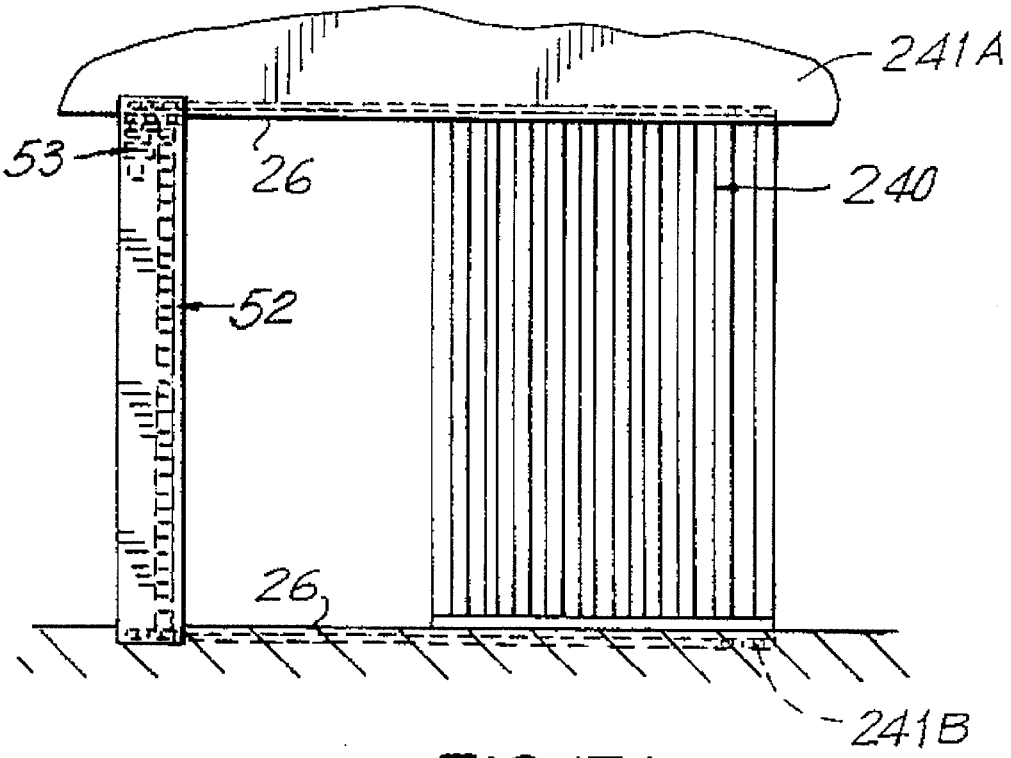
Figure 17B:
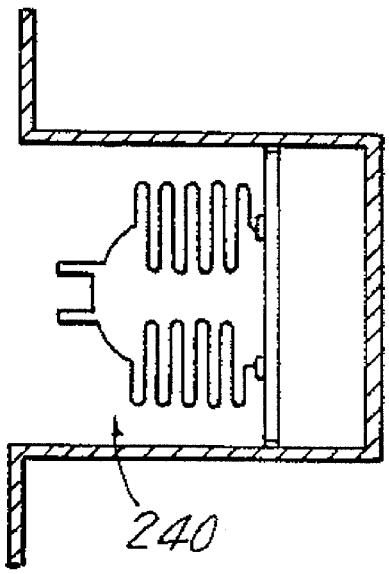
Figure 18:
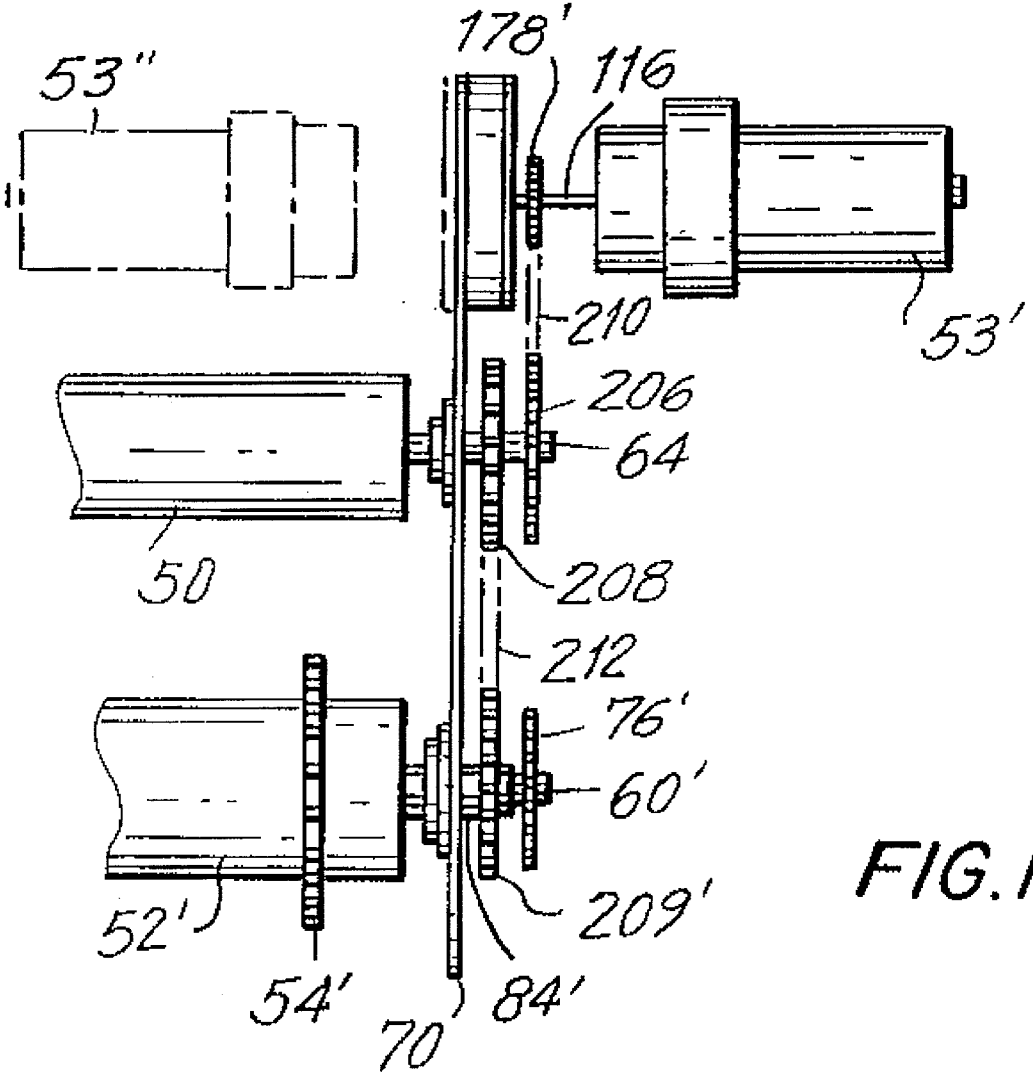

FIGS. 10 and 11, taken together with FIG. 10 on the left and FIG. 11 on the right, make up an exploded perspective view of the interior of the regulating mechanism;

FIG. 12 is a cross-sectional view of a releasing mechanism shown in FIG. 10;

FIG. 13 is a perspective view of a side closing fire door according to another embodiment of the present invention;

FIG. 14 is a schematic drawing depicting a vertical fire door closing from the top to the bottom;

FIG. 15 is a schematic drawing depicting a vertical fire door closing from the bottom to the top;

FIG. 16 is a perspective view of a side closing fire door having a substantially horizontal member according to still another embodiment of the present invention;

FIG. 17A is a perspective view and FIG. 17B is a cross-sectional view of a side closing fire door having an accordion-type member according to still yet another embodiment of the present invention: and FIG. 18 is schematic drawing of a side closing door according to a further embodiment of the present invention.

DETAILED DESCRIPTION OF THE PRESENTLY PREFERRED EMBODIMENTS

Figures 1, 2:
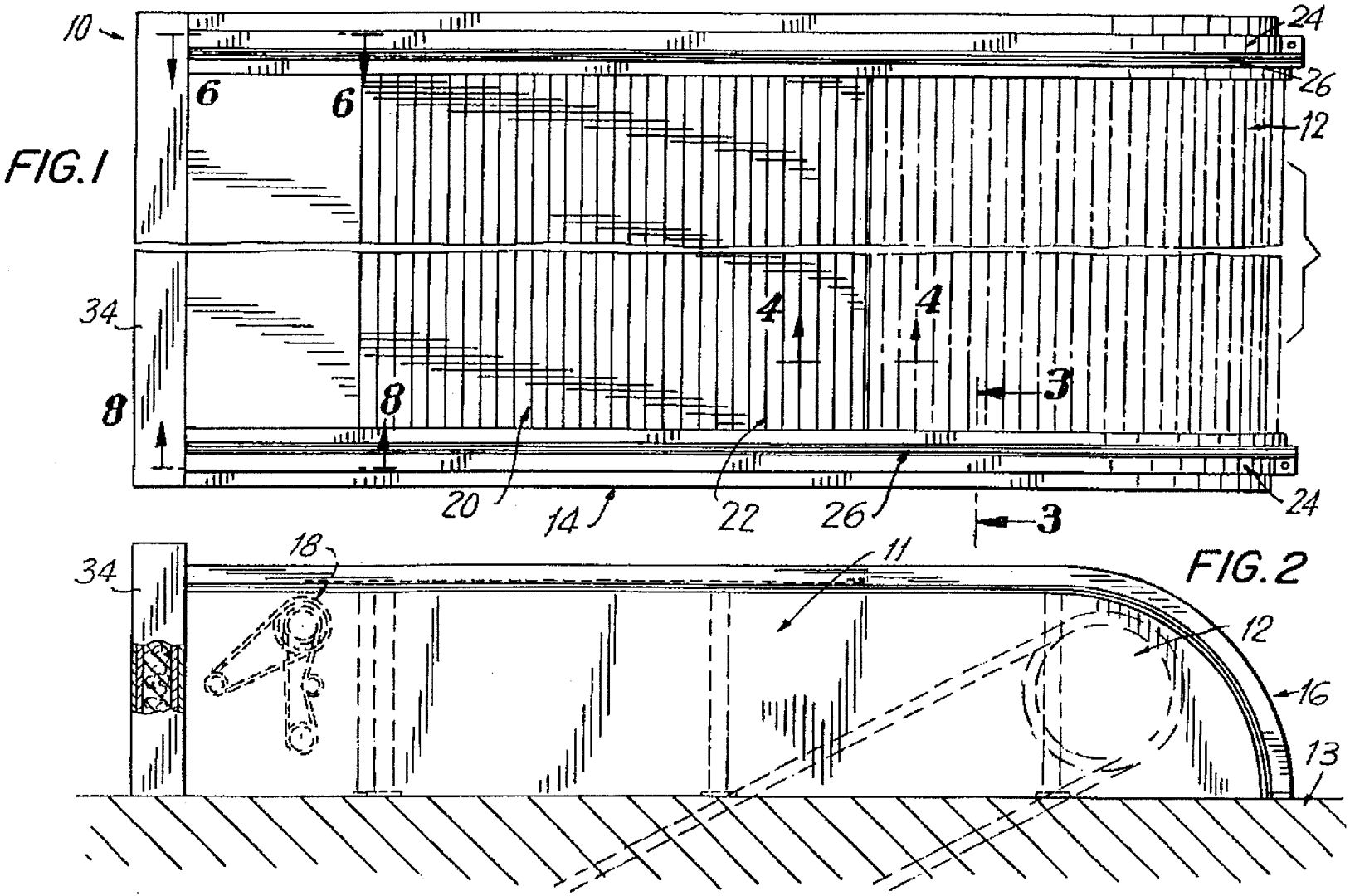
FIG. 1 is a top plan view of a horizontal fire door according to the present invention.
FIG. 2 is a side view of the horizontal fire door of FIG. 1.

Turning now to the drawings, FIGS. 1 and 2 depicts a horizontal fire door, generally indicated by reference numeral 10, for opening and closing a horizontal opening such as an opening 11 in a floor 13 of a building for an escalator 12 arranged between the floor 13 and a floor below (not shown). The horizontal fire door 10 comprises a substantially horizontal portion 14 for enclosing the horizontal opening 11, a substantially arcuate portion for enclosing the entrance to escalator 12, and a mechanical portion 18 which comprises the mechanisms for opening and closing the horizontal fire door 10. The details of the mechanical portion 18 will be discussed herein below.

Figure 3:
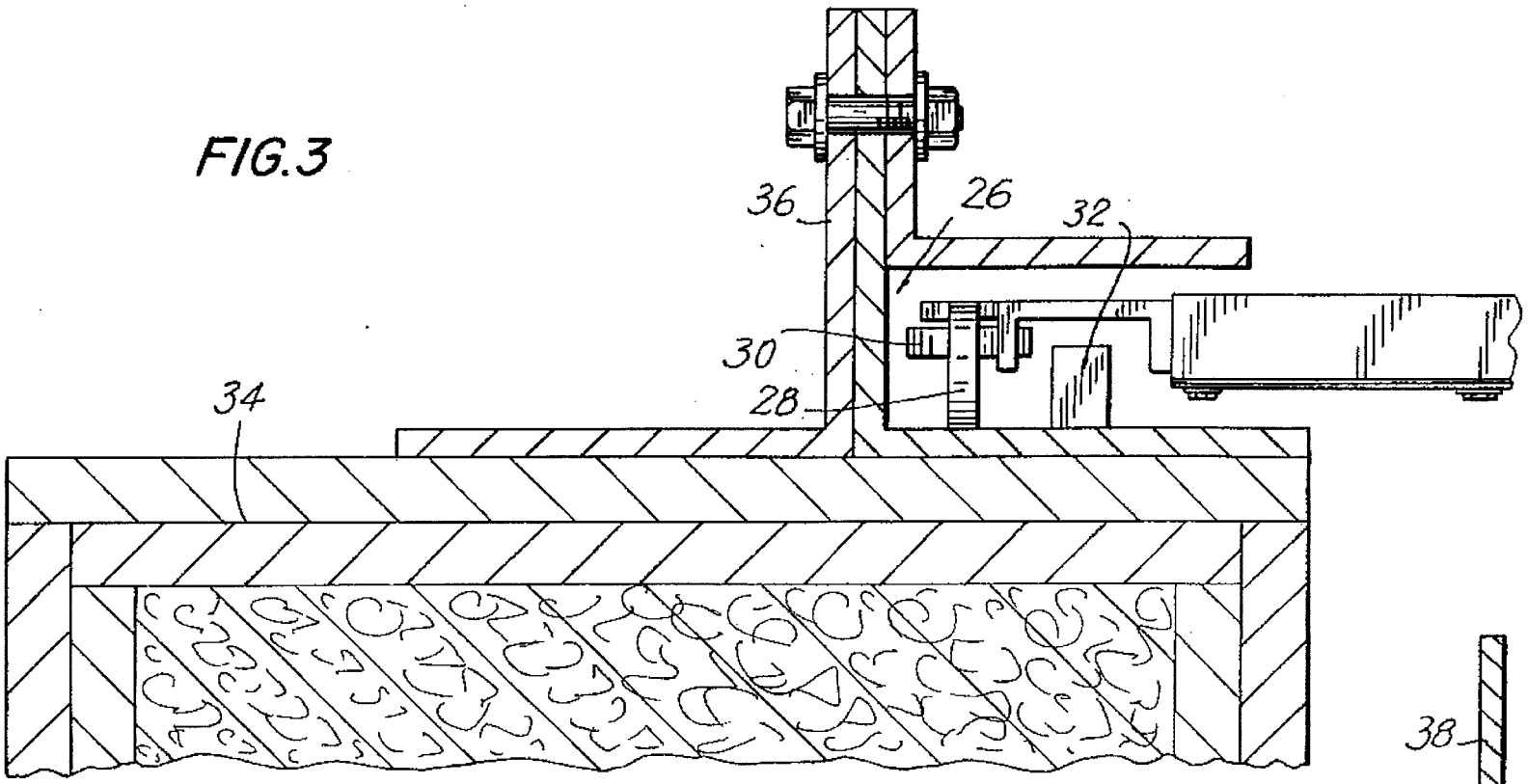
FIG. 3 is a sectional view in enlarged scale taken along line 3—3 in FIG. 1.
Figure 5:
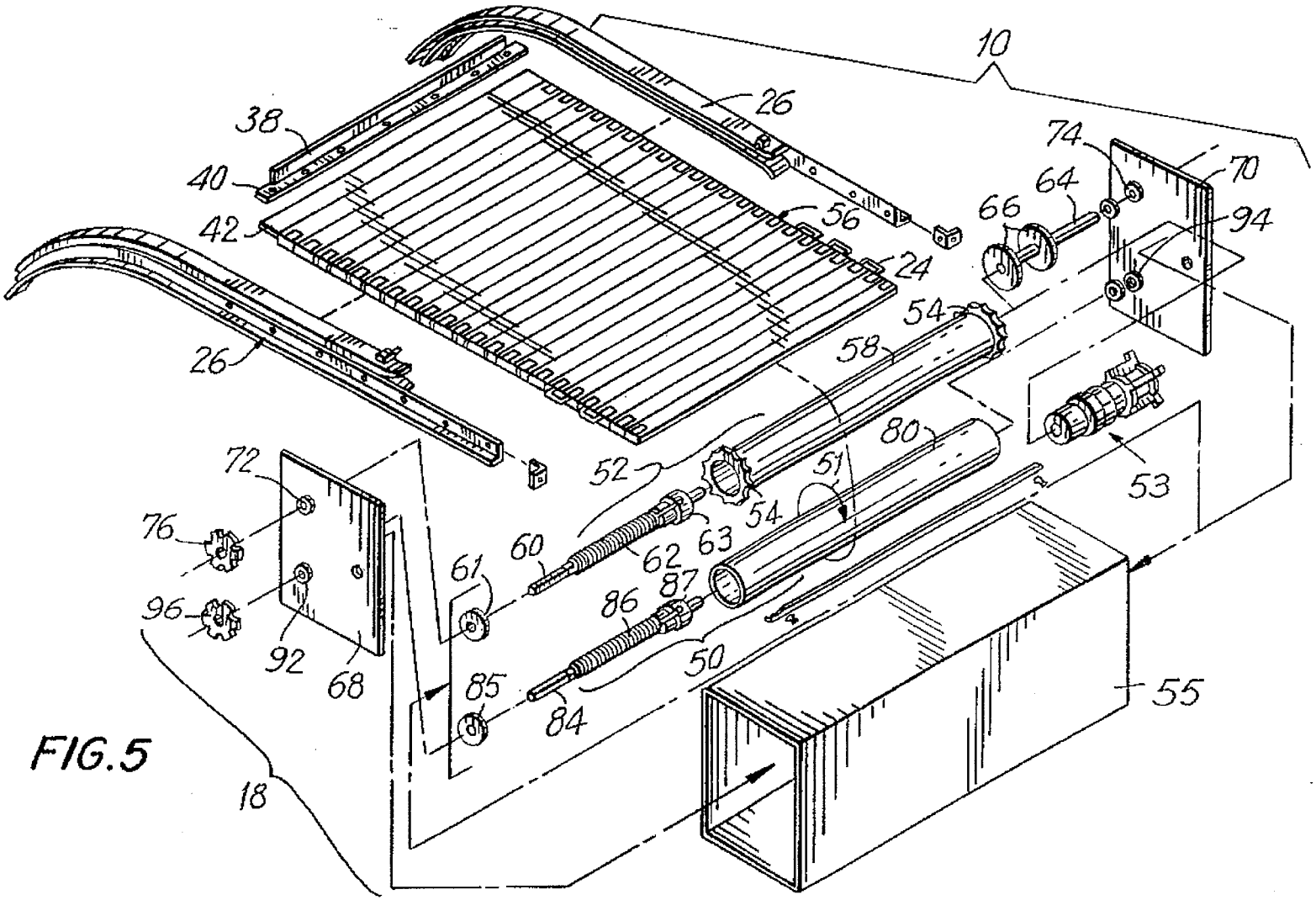
FIG. 5 is exploded perspective view of the fire door of FIG. 1 incorporating a regulating mechanism embodying the present invention.
Figure 7:
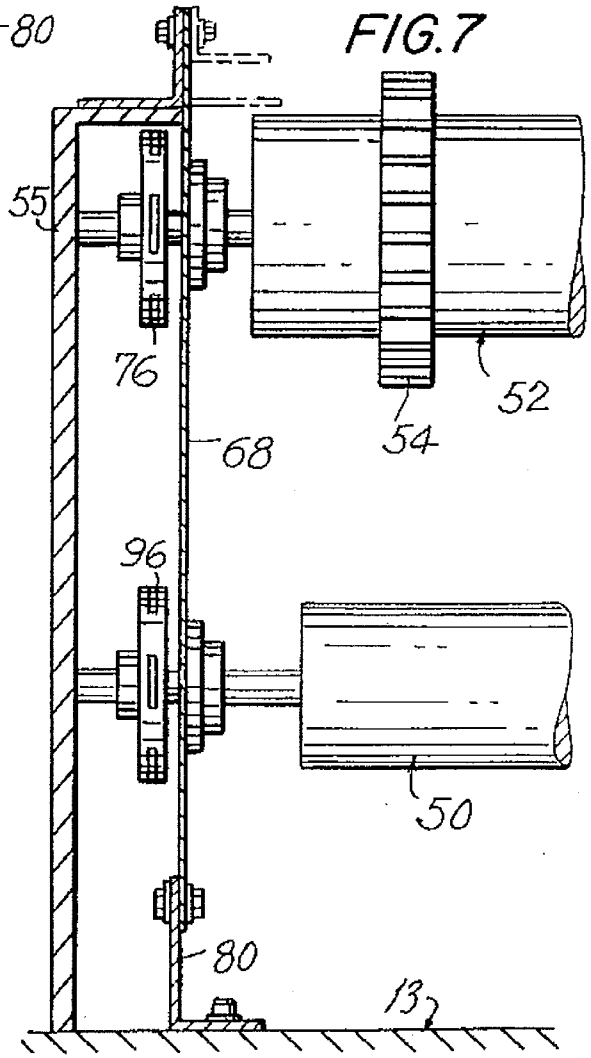
FIG. 7 is a cross-sectional view of a releasing mechanism taken along line 7—7 in FIG. 6.

The horizontal fire door 10 comprises a curtain 20 having a plurality of interconnecting relatively pivotal parallel slats 22 which are kept in alignment by endlocks 24, as best seen in FIG. 5. As shown and presently preferred, endlocks 24 lock each end of alternate slats to act as a wearing surface for maintaining slat alignment. The horizontal door is arranged to travel preferably in a pair of guide means such as channels 26 positioned on either side of the horizontal door 10. As shown in greater detail in FIG. 3 and presently preferred, the horizontal door 10 travels along the channels 26 by means of, by way of example, horizontal rollers 28. The horizontal door 10 is further kept in alignment by, for example, vertical rollers 30. The rollers 28, 30 are maintained in alignment by a guide bar 32. The channels 26 are provided for guiding the movement of slats 22 from an opened position to a closed position. While the preferred embodiment for the fabrication of the slats 22 of the curtain 20 is either galvanized or stainless steel, other fireproof or fire retardant materials according to Underwriters Laboratories (UL) and/or National Protection Association (NFPA) requirements are acceptable. The channels 26 are secured to a masonry wall 34 or other structure by mounting angle 36. Since the channels 26 are preferably made of metal or the like, they are slotted to allow for heated expansion of the metal when a fire occurs to prevent the channels 26 from deforming and making the door nonfunctional.

Figure 4:
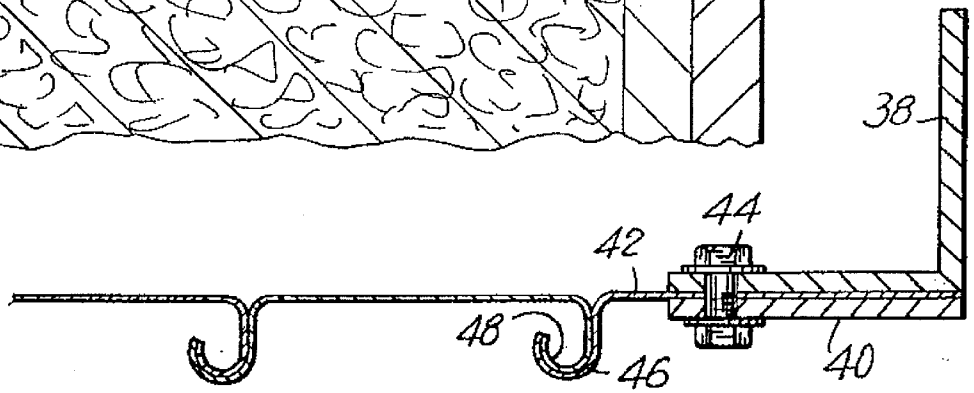
FIG. 4 is a sectional view in enlarged scale taken along line 4—4 in FIG. 1.

As shown in FIGS. 4 and 5 and as presently preferred, at one end of curtain 20 an angle 38 and a flat bar 40 are attached to the last slat 42 by, for example, a threaded bolt assembly 44. The angle 38 and the flat bar 40 add mechanical strength to the door 10 and seal the opening when the door is in the closed position to act as a fire stop. Like the channels 26, the flat bar 40 is slotted to allow for heat expansion of the metal.

As best shown in FIG. 4 and in accordance with the present invention, one end of each slat 22 comprises a semicircular hook portion 46 having an inside radius of a predetermined size and the second end comprises a mating hook portion 48 having slightly smaller outside radius, such that the second end of one slat is received by the first end of an adjacent slat.

The details of the mechanical portion 18 of the door 10 are shown in FIG. 5. The mechanical portion 18 comprises first and second elongated members 50, 52 and a regulating member enclosed in an enclosure 55. The enclosure 55 comprises end plates 68 and 70 mounted to the wall 34 or floor 13 with mounting angles 80.

The second end of curtain 20 is fixed, by conventional means, to the first horizontal elongated member 50. The curtain 20 is draped over the second horizontal elongated member 52, as shown by the arrow 51 in FIG. 5. The second horizontal elongated member 52 comprises two cog wheels 54. The curtain 20 comprises notches 56 arranged in confronting relation with the teeth of the cog wheels 54, such that the cog wheels 54 are arranged to mate with the notches 56. Of course as will be appreciated by one of ordinary skill in the art, while only two cog wheels have been shown, any number of cog wheels can be utilized in accordance with the size of the door. The second elongated member 52 is used to drive the curtain 20 from the opened position to the closed position and vice versa. The curtain 20 is arranged to wind and unwind around the first elongated rotatable member 50 which serves essentially as a take-up reel. A regulating mechanism 53 is provided driving the member 52 for opening the curtain 20 and for regulating the speed of closing. The details of the regulating mechanism 53 will be discussed hereinbelow.

Figure 6:
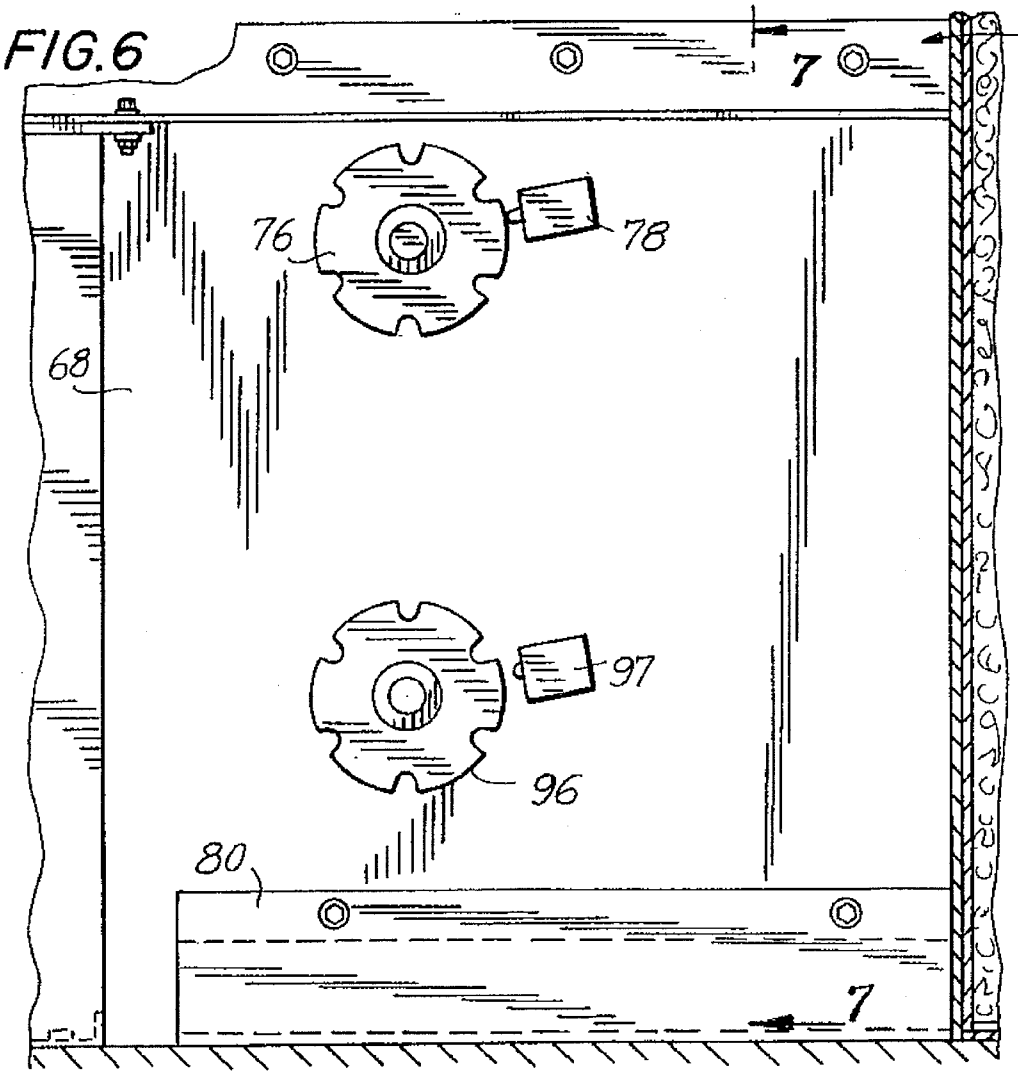
FIG. 6 is a sectional view in enlarged scale taken along line 6—6 in FIG. 1.

In the preferred embodiment, the second elongated member 52 comprises an outer tube 58 and an axially aligned inner shaft 60, the latter being supported by a bearing 61. A portion of the inner shaft 60 extends outwardly from one end of the outer tube 58. A resilient tensioning means 62 is provided having a first end connected to the inner shaft 60 and a second end connected to an axially-aligned sleeve 63 which is attached, for example, by a bolt (not shown) to the outer tube 58. As shown, the preferred resilient tensioning means comprises a helical spring, but as will be readily apparent to one of ordinary skill in the art, other types of resilient tensioning means can be utilized. The second end of the second elongated member 52 is operatively connected to a plug shaft 64 in axial alignment therewith by a connecting means comprising two discs 66 mounted on plug shaft 64 attached to, by way of example welding to the outer tube 58. The second elongated member 52 is supported by end plates 68 and 70. More particularly, the outwardly extending end of the inner shaft 60 extends through an opening in the end plate 68, and one end of the plug shaft 64 extends through an opening in end plate 70. Both shafts 60 and 64 are supported in their respective openings by bearings 72 and 74, respectively. A tension wheel 76 and engaging pawl 78 are provided to fix the end of shaft 60 with respect to end plate 68, as best seen in FIG. 6. As will be explained in detail below and in accordance with the present invention, when the plug shaft 64 is rotated to open or close the curtain 20, the outer tube 58 also rotates in the same direction. Moreover, when the plug shaft 64 is rotated in a direction to open the curtain, the resilient tensioning means 62 is placed in tension, to thereby store energy in that direction. As will be apparent to one of ordinary skill in the art, the tensioning means 62 may be arranged to store energy while the curtain 20 is opening instead of closing.

The first elongated member 50 comprises an outer tube 82 and an axial aligned inner shaft 84 supported by a bearing 85. A first end of the inner shaft 84 extends outwardly from a first end of the outer tube 82 and a second end of the inner shaft extends outwardly from the other end of the outer tube 82. A resilient tensioning means 86 such as a helical spring is provided having a first end connected or pinned to the inner shaft 84 and a second end connected to a sleeve 87. The sleeve 87 is, for example bolted to the outer tube 82. The first elongated member 50 is also supported by end plates 68 and 70. As best seen in FIG. 5, the first outwardly extending end of the inner shaft 84 extends through an opening in the end plate 68, and the other end of the inner shaft 84 extends through an opening in end plate 70. Both ends of shaft 84 are supported in their respective openings by bearings 92 and 94, respectively. The desired amount of tension of the resilient tensioning means 62 is preset by manually rotating the first elongated member 50, for example by 8 to 10 rotations, while locking a tension wheel 76 with a pawl 97, as shown in FIG. 6. As will be explained below the outer tube 58 and the inner shaft 84 are rotated together such that the resilient tensioning means 62 is maintained in constant tension to prevent binding or buckling of curtain 20 around the first elongated member 50.

While in the preferred embodiment the regulating means 53 is shown mounted to end plate 70 above the first elongated member 50, the regulating means 53 may be mounted to the other end plate 68, may be placed directly in front of the enclosure, either under or outside the enclosure, or in axial alignment with the end of elongated member 52. As will be appreciated, if the regulating means is placed in axial alignment with the second elongated member 52, additional speed reduction may be required.

The preferred embodiment of the regulating mechanism 53 is shown in FIGS. 10–12. The preferred embodiment includes a means, such as a motor (not shown) disposed in a cylindrical housing 100 and having a high starting torque, for rotating the input shaft 108 of the regulating mechanism. The motor may be a constant-speed, multi-speed, adjustable-speed or varying-speed motor or the like and may be driven pneumatically, electrically or hydraulically. Under normal operation, power is fed to tile motor 100 via a control box (not shown). An additional electrical power source for the motor 100, such as a generator, battery or the like (not shown), may be connected to the motor to provide auxiliary power in case of a power failure. The drive shaft of the motor 100 (not shown) passes through a hand chain assembly (not shown) disposed in cylindrical collar 102 secured motor housing 100 and serves to drive a knurled shaft 104 in operative-engagement with a coupling 106 having a knurled interior. The coupling 106 is also in operative engagement with knurled coupling 107. The knurled coupling 107 passes through a hole 110 in a support plate 114 of a brake releasing mechanism 112 and is operatively engaged to input shaft 108. The input shaft 108 drives an output shaft 116 of the regulating mechanism 53 in order to raise or lower the fire door 12, as more fully discussed below.

The brake releasing mechanism 112 is housed on one side of the sheet metal cylindrical housing 118. The other side of the housing 118 mates with collar 102 for defining therewith a housing for the hand chain assembly 102, shaft 104, and couplings 106, 107. The brake releasing mechanism is arranged to release a brake 130 to permit rotation of the input shaft 108 to open or close the curtain 20. The brake releasing mechanism may be initiated by any one of a detection of a fire, manually initiation, by means of a movable chain 134 or the like, or by starting the motor from the control box (not shown), by means of a solenoid 140 or the like, as more fully explained below.

Referring to FIG. 12, the releasing mechanism 112 comprises a sash chain 120 connected to one end of a temperature sensitive means 122, such as a fusible link or the like, the other end of the fusible link 122 being connected to a wall or other stationary support. As is well know, the fusible link may comprise two pieces of metal held together by low melting-point solder. The sash chain 122 is operatively connected to one end of a plunger shaft 123 with a hook-like member 127. The plunger shaft passes through a channel member 123 and terminates with a plunger 124 on the other end thereof. A compression spring 126 is disposed concentrically around plunger shaft 125 and is arranged between and abutting plunger 124 and a wall of channel 123. While the fusible link is intact, the sash chain 120 is in tension and pulls the plunger shaft 125, thus compressing spring 126 to position plunger 124 in a withdrawn position and is thereby not in contact with a lever 128. When the ambient temperature surrounding the fire door reaches a predetermined level, the low melting-point solder of the fusible link 122 melts and the fusible link separates, releasing the tension on the sash chain 120. With this tension removed, the spring force of compression spring 126 moves the plunger 124 to engage the lever 128 which in turn rotates a brake moving means or cam 136 to disengage the brake 130 (FIG. 10), as more fully explained below. This disengages or releases brake 130 to permit the curtain 20 to move to its closed position under the urging of the second elongated member 52. After a melted fusible link 122, has been replaced, the sash chain is placed in tension, thus pulling plunger shaft 125. The compression spring 126 is again placed in compression and the plunger 124 is separated from lever 128. An expandable spring 138 restores lever 108 to its previous position, thus turning cam 136 to thereby engage brake 130.

To manually initiate the brake release mechanism 112, to close curtain 20, a person merely pulls chain 134, which is attached to lever 128. Similar to the plunger 124 arrangement, by pulling on chain 134, lever 128 turns cam 136, thus releasing brake 130. This disengages or releases brake 130 to permit the curtain 20 to move to its closed position under the urging of the second elongated member 52. When the chain 134 is released, the lever 128 is restored to it's previously position under the urging of spring 138 to engage the brake 130 to prevent rotation of the shaft 106 to stop the movement of the curtain 20.

Alternatively, the brake release mechanism 112 may be arranged to disengage the brake upon the loss of electrical power so as to open or close curtain 20. Such an arrangement has been described in application Ser. No. 07/880,094, filed May 7, 1992 and commonly assigned herewith.

When the motor is started from the control panel to open or close the curtain 20, the solenoid 140 is energized to engage lever 128 thus rotating cam 136 to release the brake 130 as described above. This permits the motor to rotate the input shaft 108 to open or close curtain 20. When the motor is stopped, the solenoid 140 is deenergized and the lever 128 is returned to its previous position under the urging of spring 138 to engage brake 130 to prevent rotation of the shaft 106 to stop movement of the curtain 20.

Referring to FIGS. 10 and 12, the preferred embodiment for the brake is an electromagnetic brake 130 of the shoe-type. Alternatively, the brake may be magnetically, hydraulically or pneumatically operated or a combination of the above. Preferably, it is a continuous duty, spring-set, solenoid-activated brake. Referring to FIGS. 10 and 12, the brake 130 includes brake shoes 132 which are movable between a braking position and a released position and the cam 136 for moving the brake shoes 132 between a braking and a released position.

By engaging or disengaging the brake 130, the input shaft 108 of the regulating mechanism 53 is either held stationary or allowed to rotate, respectively. When the brake 130 is engaged and the brake shoes 132 are in a brake position and engage a cast iron barrel 142 which surrounds the brake shoes 132. The brake shoes 132 hold the cast iron barrel 142 stationary which in turn prevents the input shaft 108 from rotating. When the brake 130 is released, the brake shoes 132 are in a released position and are not engaging the iron barrel 142. This allows the iron barrel 142 to rotate which in turn allows the input shaft 108 to rotate either in response to the motor or under the urging of the second elongated member 52.

Attached to the cast iron barrel 142 is a governor 144 which is a mechanical device that limits the rotational speed of shaft 108 and barrel 142 to thereby control the speed of closing or opening of the door. In its preferred embodiment, the present invention comprises a centrifugal governor 144 preferably including two brake shoes 146 which are connected to each other at a pivot point 148. The governor is connected to shaft 108 and drum 142 as by a pin 150 to rotate therewith. Two tension springs 152 hold the brake shoes 146 in a closed position until the input shaft 108 is rotated at or above a preset speed at which point the brake shoes 146 begin to separate due to centrifugal force and thus apply a braking friction against the inside of a housing 154 to slow the speed of the input shaft 108. Thus, for example, the governor may be set to operate when the input shaft 108 rotates in excess of, by way of example, 1700 revolutions/min (RPM) to prevent the input shaft 108 from exceeding that rotational speed. Additionally, the governor may operated pneumatically or hydraulically.

The input shaft 108 is then connected to a splined shaft 156 which drives a speed reduction gearing 158. The speed reduction gearing 158 may be of any suitable type but, as shown and preferred, comprises a planetary gearing assembly 160 which is housed in a gear housing 162 having its internal surface toothed to mesh with the planetary gears 164 and 166. The planetary gearing assembly 160 creates a large gear ratio of the order of, for example, 77:1 between the input shaft 108 and the output shaft 116, thereby decreasing the speed of the output shaft 116 to approximately 22 RPM, assuming the speed of input shaft 108 is 1700 RPM. Of course, other selected maximum speeds for the input shaft 108 will result in either a lower speed for the output shaft, or the use of a different gear ratio in the planetary gearing or some combination thereof as design criteria mandates. Additionally, the planetary gearing assembly 160 can be driven forward or backward unlike conventional worm gear or helical gear units which can not be driven backwards in this design configuration. The preferred embodiment of the present invention includes at least two sets of axially aligned planetary gearing, with the sun gear being a splined shaft 156 with at least 3 planet gears 164 surrounding it. The splined shaft 156 is connected to and rotates a drive plate 168 which in turn engages another splined shaft 170 which in turn rotates the set of planet gears 166 which in turn drives a drive plate 172. The low speed output shaft 116 is connected to the drive plate 172.

A limit switch sprocket 174 is connected to the low speed output shaft 116 which extends through a base 176 to engage the drive sprocket 178 and the chain drive 180 as will be explained below. A limit switch assembly 182 controls the extent of the opening and closing movement of the fire door 10 and is driven by the limit switch rolling chain 184. The output shaft 116 rotates the limit switch sprocket 174 which in turn drives a limit switch sprocket rolling chain 184 to rotate a second limit switch sprocket 186 to engage the limit switch assembly 182 so that the opening and closing movement of the curtain 20 is controlled.

Figures 8, 9:
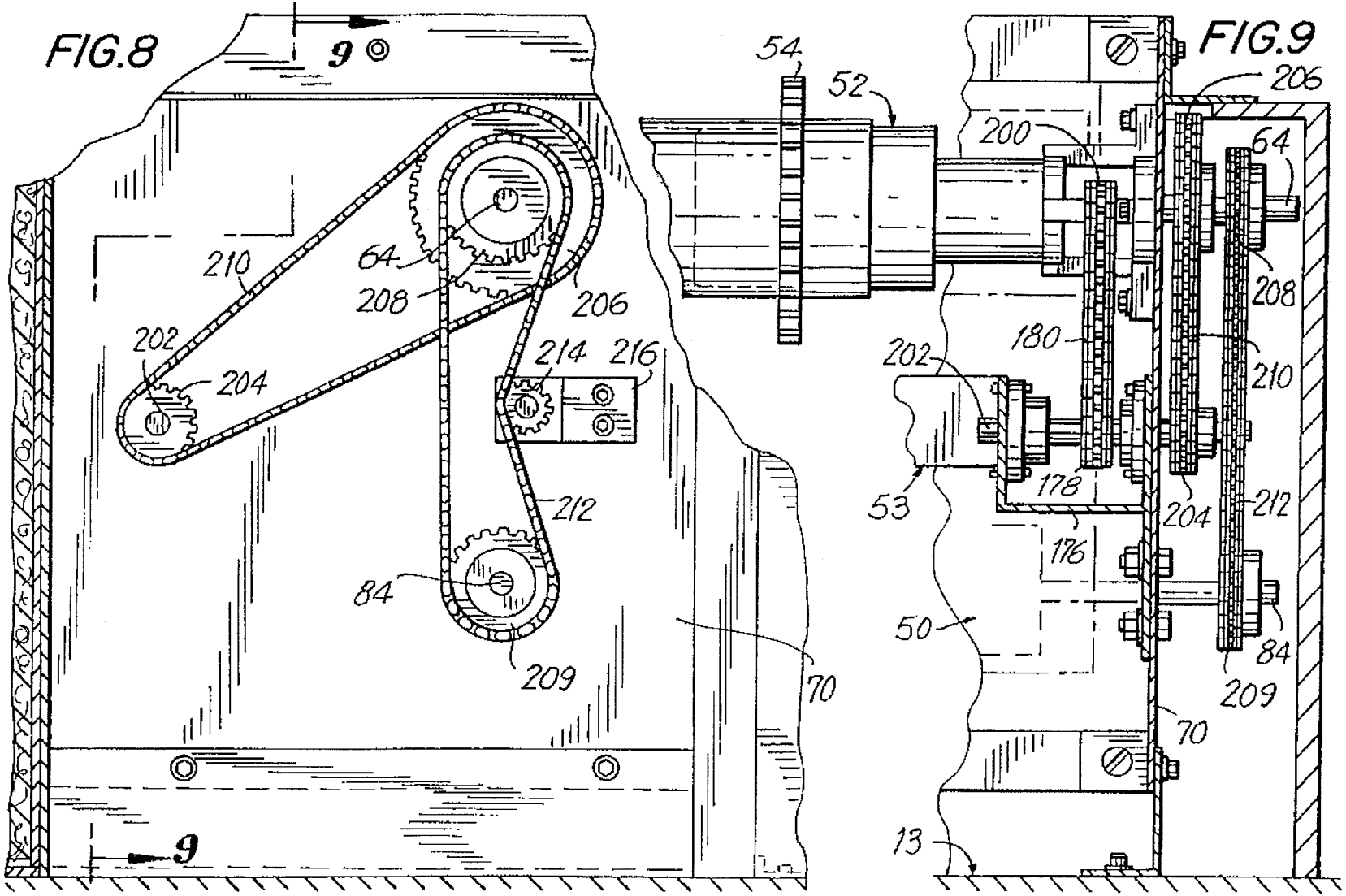
FIG. 8 is a sectional view in enlarged scale taken along line 8—8 in FIG. 1.
FIG. 9 is a cross-sectional view of a releasing mechanism taken along line 9—9 in FIG. 8.

As best seen in FIG. 9, the regulating mechanism 53 is then mounted to the end plate 70 by the base 176 which preferably has three bolts for attachment to the end plate 70 to allow the base to move easily. This configuration of the chain drive 180 and the speed reduction gearing regulates the speed of the door closing and opening. The chain drive 180 which is placed between the regulating mechanism 53 and the elongate rotatable members 50, 52 of the door 12 has a speed reduction ratio of for example 5 to 1 and the planetary gearing assembly 170 has for example a speed reduction ratio of 77 to 1. Therefore the total speed reduction ratio between input shaft 108 and the rotatable member 36 to control the opening and closing of the door 10 results in a 385 to 1 mechanical advantage thereby resulting in a reduced power requirement to open and close the door 10. However, with the governor on the high speed end of the power train, its regulation is sensitive and precise.

The regulating mechanism 53 may also be configured with the motor being placed between the speed reduction gearing and the governor to control the raising and lowering of the curtain. This will not adversely affect the operation of the door as the governor will continue to act on the high speed portion of the power train. Additionally, the brake may be placed either before or after the speed reduction gearing of the regulating mechanism without adversely affecting the operation of the door as the brake will continue to prevent the output shaft of the regulating mechanism from rotating when the brake is engaged and allow the output shaft to rotate when it is disengaged.

Referring to FIGS. 8 and 9, chain drive 180 is engaged to another sprocket gear 200 which is mounted on an end of a shaft 202. The shaft 202 passes through end plate 70 and terminates with another sprocket gear 204. As previously discussed, plug shaft 64 and shaft 84 each pass through the end plate 70. A pair of sprocket gears 206 and 208 are arranged coaxially on the end of plug shaft 64, and a sprocket gear 209 is arranged coaxially on the end of shaft 84. As presently preferred, a drive chain 210 is arranged in operative engagement with sprockets 204 and 206, and a sprocket gear 208 is operatively connected to sprocket gear 209 by means of drive chain 212. A tensioning sprocket is arranged mounted, for example by bolts, on a plate 214 preferably between the sprocket gears 208 and 209 to provide the appropriate amount of tension of the drive chain 212.

Accordingly, as the motor rotates to open or close the door, the first and second elongated members 50 and 52 rotate while being driven by sprocket gears 204, 206, 208 and 209 and drive chains 210 and 212. As the second elongated member rotates, cog wheels 54 drive curtain 20 to the opened or closed position. Additionally, rotation of the second elongated member 52 to the opened position causes the resilient tensioning means 62 to be placed in tension, thus storing energy. Further, as the shaft 84 is rotated the tension of the resilient tensioning means 86 is maintained substantially constant irrespective of the degree of opening or closing of the curtain 20. This prevents binding or buckling of the curtain 20 around the first elongated member 50.

Alternatively, as is apparent, the resilient tensioning means 62 can be arranged such that when the motor closes the curtain 20, the resilient tensioning means 62 is placed in tension, to store energy. In this arrangement, when the curtain 20 is in the closed position and the brake is released, the curtain 20 will open under the urging to the resilient tensioning means 62. In this arrangement, the brake release mechanism 112 may be arranged to disengage the brake upon the loss of electrical power so as to open the curtain 20.

As will be appreciated by one of ordinary skill in the art, the door 10 can be arranged to close an opening from one side to another side as shown in FIG. 13 or from the bottom to the top as shown in FIG. 15 without modification of the door or any of its mechanisms.

FIG. 18 illustrates an alternate arrangement of the mechanical portion 18 of a side closing door. The mechanical portion comprises a first elongated member 50, which is the same as the first embodiment, a second elongated member 53' which is substantially the same the first embodiment and a regulating mechanism 53'. The second elongated member is the same except that the plug shaft 84' is hollow to allow inner shaft 60' to pass therethrough. The tension wheel 76' is thus placed on the end of shaft 60' to fix the position of the inner shaft 60' and is position at the top of door 10. Additionally, as seen from that figure, the regulating mechanism 53' can be mounted either on top of end plate 70 or just below it, as shown in dotted lines. The operation and control of the regulating mechanism 53' is the same as previously described with respect to the first embodiment. The output shaft of the regulating mechanism 116 terminates in a sprocket gear 178', similar to the first embodiment. The regulating mechanism turns sprocket gear 178' which drives chain 210. Chain 210 rotates shaft 64 to rotate sprocket 208 to turn chain 212. Chain 21 drives sprocket gear 209' to thus turn the second elongated member 52'. The operation of this embodiment is the same as the first embodiment. This arrangement allows for simpler construction of the door since no access facility need be provided underneath the floor (not shown) at the base of the mechanical portion 18. Access to the regulating mechanism 53' and other described components may be provided through access panels (not shown) in the ceiling.

In another embodiment the rolling curtain may be substituted with a door having a substantially planar member 220, as best seen in FIG. 16. As shown in that figure, the planar member 220 comprises notches 222 for operative engagement with cog wheels 54 of elongated member 52. The planar member 220 travels from an opened position to a closed position along guide rails 224.

In yet another embodiment the door may comprise an accordion-like member comprising two confrontingly disposed articulated walls formed of a flexible reticulated material as shown in FIGS. 17A and B. Referring to FIGS. 17A and 17B, the door comprises an accordion-like member 240 comprising two confronting articulated walls formed of a flexible reticulated material as shown most clearly in FIG. 17B. A guide or channel 26 is positioned on each side of the accordion-like member 240 for guiding the accordion-like member 240 for movement between a first or opened position and a second or closed position. A regulating means 53 is connected to the accordion-like member 52 via one or more motion chains 241A, 241B, as is known in the art, for regulating the speed of movement of the accordion-like member 240. As described in detail above with respect to FIGS. 1 to 16, the regulating means 53 similarly comprises a speed reduction means for reducing a rotational speed, a high speed input shaft connected to the speed reduction means, and a low speed output shaft connected to the speed reduction means. The regulating means 53 is operable in a first direction toward the closed position and a second direction toward the opened position. Note that like planar member 220 of FIG. 16, the accordion-like member 240 of the embodiment of FIGS. 17A and 17B does not wrap around a take-up reel such as first horizontal member 50 in FIG. 5. Accordingly, member 50 is not required and, therefore, is not shown in the embodiments of FIGS. 16, 17A and 17B. A self-closing mechanism 52 is operatively connected to the accordion-like member 240 via chains 241 and is adapted for storing energy when the accordion-like member 240 is moved to the opened position by imparting motion to chains 241. A connecting means operatively connects the output shaft to the self-closing mechanism 52, and a brake is provided for preventing rotation of the output shaft. A releasing means releases the brake to permit rotation of the output shaft under the urging of the self-closing mechanism, such that the self-closing mechanism releases the stored energy so as to close the accordion-like member 240 to the closed position when the brake is released by the releasing means.

OPERATION

The operation of the fire door 10 will now be explained. The fire door 10 will assumed to be in an initial fully closed position. The opening of the door is easily accomplished by operating the control panel to energize the motor to open the door without the need for any adjustments or manipulations of the equipment or regulating mechanism. As will be described in greater detail hereinafter, the ordinary control mechanism for the motor (not shown), would preferably include an "Open" button, a "Close" button and a "Stop" button, which buttons, through conventional control means will operate the polarity or phase of energization of the motor so as to cause it to rotate in an "Open" direction or a "Close" direction.

In the closed position, when the "Open" button is actuated, the motor will be actuated to start opening the curtain 20 and contemporaneously, solenoid 140 will be energized releasing brake 130 to permit rotation of input shaft 108. The brake 130 disengages the input shaft 108 to allow the motor to drive the input shaft 108 which in turn drives the speed reduction gearing 158 to drive the output shaft 116 to rotate sprocket gears 178, 200, 204, 206, 208 and 209 and drive chains 180, 210 and 212 to thus drive the first and second elongated members 50 and 52. As the elongated member 52 rotates, the cog wheels 54, which are in operative engagement with the notches 56, drive the curtain 20 to the opened position and the resilient tension means 62 is placed in tension, thereby storing energy. Simultaneously, the resilient tensioning means 86 is driven so as to wind the curtain 20 around the outer tube 80. As the curtain 20 is moved to the fully opened position, the limit switch assembly 182 will operate to de-energize the-motor and to reset the solenoid control brake 130 and thereby relock the input shaft 108 and, thus, the curtain 20 in the opened position.

If a fire occurs with the fire door in its opened position, the fusible link 122 melts, releasing the sash chain 120 which releases the plunger 124 under the urging of the compression spring 126. The plunger 124 pushes the lever 128 to engage the brake moving means or cam 136 to release the brake 130. Once the brake 130 has been released, the input shaft 108 and output shafts 116 are free to rotate. Accordingly, the first and second elongated members 50 and 52 are also free to rotate under the urging of the resilient tensioning means 62, which was placed in tension when the door was opened, to thereby drive the curtain 20 to the closed position. Additionally, the curtain 20 can also be closed upon manual initiation without any auxiliary electric power. The speed of the curtain closing is regulated by governor 142, to thus allow the curtain 20 to close gradually, to prevent injury to escaping personnel and damage to the door. As the curtain 142 closes, it rotates the elongated member 52 which through the chain drive 180 rotates shaft 116, which through planetary gearing 132 and 138 rotates input shaft 108. Additionally, during the closing of the door 10, the regulating mechanism 53 does not disengage the motor from the door 12. The motor remains connected and thus operable to open or close the door if there is electrical power available.

The present invention may also be used for a door that is capable of high cycle operation, i.e., 50,000 to 100,000 cycles or runs. The control box (not shown) may be connected to the motor to allow the regulating mechanism 53 to raise and lower the door. A control station for the control box, including buttons, switches or the like, may comprise an "Open" button, a "Close" button and a "Stop" button. When the "Open" button on the control panel is pressed-or engaged, the control box sends a signal to the solenoid 140 which releases the brake 130. The brake 130 disengages the input shaft 108 to allow the motor to drive the input shaft 108 which in turn drives the regulating mechanism 53 to drive the output shaft 116 to wind the curtain 20 around the first elongated member 50. When the "Close" button is pressed the motor drives the shafts and the regulating mechanism 53 in the opposite direction to unwind the curtain 20 from the elongated member 50 until the curtain 20 closes. Alternatively, when the "Close" button is pressed the solenoid 140 is energized, thereby disengaging the brake to permit self-closing of the door as discussed previously.

When the curtain 20 reaches a predetermined limit due to the configuration of the limit switch assembly 182, the power to the motor is cut off and a signal is sent to the solenoid 140, which re-engages the brake 130. The door stops at an open position or closed position because of the limit switch assembly 182. The stop button or switch can stop the motor from either raising or lowering the curtain 20.

In emergency situations, the hand chain assembly 102 can operate the door 10 during a power failure or removal of the motor for inspection or servicing. The hand chain assembly 102 is activated when a lever chain 230 is pulled to engage a lever 232. The lever 232 activates the hand chain assembly 102 so that a hand chain 234 can then be pulled to rotate the shaft 104 of the coupling 106 to rotate the input shaft 108 of the regulating mechanism 53.

Additionally, a safety edge device may be incorporated with the bottom bar 38 so that in the event a person was beneath the door as it was closing, the safety edge device would be triggered and would immediately reverse the door to the open position momentarily and then again permit the door to begin its descent to secure the opening from a fire. This safety edge device would continue to work so long as electrical power is provided to the motor. It is for this reason among others that auxiliary power may be desirable.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A door comprising:

an accordion-like member comprising two confrontingly disposed articulated walls formed of a flexible reticulated material;

a guide positioned on at least one side of said accordion-like member for guiding said accordion-like member for movement between a first or opened position and a second or closed position;

regulating means for regulating the speed of movement of said accordion-like member comprising a speed reduction means for reducing a rotational speed, an input shaft connected to said speed reduction means, an output shaft connected to said speed reduction means, said speed reduction means for reducing the rotational speed of said output shaft relative to said input shaft, wherein said regulating means is operable in a first direction toward the closed position and a second direction toward the opened position;

a self-closing mechanism operatively connected to said output shaft and said accordion-like member for moving said accordion-like member to its closed position, said self-closing mechanism incorporating movable means for storing energy as said accordion-like member is moved to its opened position, the stored energy acting through said movable means for urging said accordion-like member to its closed position;

a brake for preventing rotation of said output shaft thereby blocking movement of said self-closing mechanism; and releasing means for releasing said brake to free said output shaft for rotation thereby freeing said movable means for releasing the stored energy for urging the door to its closed position.

2. A door according to claim 1, wherein said self-closing mechanism comprises an inner shaft, an outer tube and a resilient tensioning means, wherein a first portion of said resilient tensioning means is operatively connected to said inner shaft and a second portion of said resilient tensioning means is operatively connected to said outer tube, wherein said outer tube is operatively connected to said output shaft and is operatively connected to said accordion-like member, and wherein said resilient tensioning means is adapted for storing energy as said accordion-like member is moved to its opened position.

3. A door according to claim 1, wherein a doorway opening is defined in a substantially horizontal plane, and wherein said accordion-like member travels from the opened position to the closed position in the substantially horizontal plane.

4. A door according to claim 1, wherein a doorway opening is defined by a top, a bottom, a first side and a second side, wherein said accordion-like member travels from the closed position to the opened position from the first side to the second side.

5. A door according to claim 1, wherein a doorway opening is defined by a top, a bottom, a first side and a second side, wherein said accordion-like member travels from the opened position to the closed position from the bottom to the top.

6. A door according to claim 1, wherein said brake releasing means further comprises temperature sensitive means for operating said brake releasing means upon the ambient temperature reaching a predetermined value.

7. A door according to claim 6, wherein said temperature sensitive means comprises a fusible link.

8. A door and a mechanism for controlling the opening and closing thereof comprising:

a door;

an input shaft connectable to a means for rotating said input shaft for opening the door;

an output shaft operatively connected to the door;

a speed reduction means connected to said input shaft and said output shaft for reducing the rotational speed of said output shaft relative to said input shaft;

a governor mounted on said input shaft for limiting the rotational speed thereof, thereby limiting the rotational speed of said output shaft;

a self-closing mechanism operatively connected between said output shaft and the door for moving said door to its closed position, said self-closing mechanism incorporating movable means for storing energy as the door is moved to its opened position, the stored energy acting through said movable means for urging the door to its closed position and means for maintaining the speed of the door substantially constant as the door is urged to its closed position;

a brake for preventing rotation of said output shaft thereby blocking movement of said self-closing mechanism; and releasing means for releasing said brake to free said output shaft for rotation thereby freeing said movable means for releasing the stored energy for urging the door to its closed position.

9. A door and a mechanism for controlling the opening and closing thereof comprising:

a door;

an input shaft connectable to a means for rotating said input shaft for opening the door;

an output shaft operatively connected to the door;

a speed reduction means connected to said input shaft and said output shaft for reducing the rotational speed of said output shaft relative to said input shaft;

a governor mounted on said input shaft for limiting the rotational speed thereof thereby limiting the rotational speed of said output shaft;

a self-opening mechanism operatively connected between said output shaft and the door for moving said door to its opened position, said self-opening mechanism incorporating movable means for storing energy as the door is moved to its closed position, the stored energy acting through said movable means for urging the door to its opened position and means for maintaining the speed of the door substantially constant as the door is urged to its opened position;

a brake for preventing rotation of said output shaft thereby blocking movement of said self-opening mechanism; and releasing means for releasing said brake to free said output shaft for rotation thereby freeing said movable means for releasing the stored energy for urging the door to its opened position.

10. The door and mechanism according to claim 8, wherein said self-closing mechanism comprises an inner shaft, an outer tube and a resilient tensioning means, wherein a first portion of said resilient tensioning means is operatively connected to said inner shaft and a second portion of said resilient tensioning means is operatively connected to said outer tube, wherein said outer tube is operatively connected to said output shaft and is operatively connected to said door, and wherein said resilient tensioning means is adapted for storing energy as said door is moved to its open position.

11. The door and mechanism according to claim 8, wherein said brake releasing means further comprises temperature sensitive means for operating said brake releasing means upon ambient temperature reaching a predetermined value.

12. The door and mechanism according to claim 11, wherein said temperature sensitive means comprises a fusable link.

13. The door and mechanism according to claim 9, wherein said self-opening mechanism comprises an inner shaft, an outer tube and a resilient tensioning means, wherein a first portion of said resilient tensioning means is operatively connected to said inner shaft and a second portion of said resilient tensioning means is operatively connected to said outer tube, wherein said outer tube is operatively connected to said output shaft and is operatively connected to said door, and wherein said resilient tensioning means is adapted for storing energy as said door is moved to its closed position.

14. The door and mechanism according to claim 9, wherein said brake releasing means further comprises temperature sensitive means for operating said brake releasing means upon ambient temperature reaching a predetermined value.

15. The door and mechanism according to claim 14, wherein said temperature sensitive means comprises a fusable link.

* * * * *